US011879694B2

(12) United States Patent
Kroschel et al.

(10) Patent No.: US 11,879,694 B2
(45) Date of Patent: Jan. 23, 2024

(54) TURBULATOR AND CHANNEL AND PROCESS APPARATUS WITH A TURBULATOR

(71) Applicant: Ehrfeld Mikrotechnik GmbH, Wendelsheim (DE)

(72) Inventors: Matthias Kroschel, Bad Kreuznach (DE); Frank Herbstritt, Alzey (DE); Johann Peter Born, Idstein (DE)

(73) Assignee: Ehrfeld Mikrotechnik GmbH, Wendelsheim (DE)

( * ) Notice: Subject to any disclaimer, the term of this patent is extended or adjusted under 35 U.S.C. 154(b) by 164 days.

(21) Appl. No.: 16/958,908

(22) PCT Filed: Dec. 20, 2018

(86) PCT No.: PCT/EP2018/086395

§ 371 (c)(1),
(2) Date: Jun. 29, 2020

(87) PCT Pub. No.: WO2019/129665

PCT Pub. Date: Jul. 4, 2019

(65) Prior Publication Data

US 2020/0340766 A1 Oct. 29, 2020

(30) Foreign Application Priority Data

Dec. 29, 2017 (DE) ..... 10 2017 131 418.0

(51) Int. Cl.

| | |
|---|---|
| ***F28F 13/12*** | (2006.01) |
| ***F28D 7/16*** | (2006.01) |
| ***F28F 1/40*** | (2006.01) |

(52) U.S. Cl.

CPC ..... *F28F 13/12* (2013.01); *F28D 7/16* (2013.01); *F28F 1/40* (2013.01); *F28F 2280/00* (2013.01)

(58) Field of Classification Search

CPC ..... F28F 13/12; F28F 1/40; F28F 2280/00; F28F 9/26; F28F 9/266; F28F 2280/06; F28F 13/06; F28F 13/08; F28D 7/16

See application file for complete search history.

(56) References Cited

U.S. PATENT DOCUMENTS

| | | | |
|---|---|---|---|
| 4,352,378 | A | 10/1982 | Bergmann et al. |
| 9,446,374 | B2 | 9/2016 | Lingvall et al. |

(Continued)

FOREIGN PATENT DOCUMENTS

| | | | |
|---|---|---|---|
| CA | 2933099 | A1 | 12/2017 |
| CN | 1573274 | A | 2/2005 |

(Continued)

*Primary Examiner* — Harry E Arant
(74) *Attorney, Agent, or Firm* — The Webb Law Firm

(57) ABSTRACT

The invention relates to a turbulator (1, 10) for a channel (21, 23, 31, 42) of a process apparatus (30, 41, 44), in particular a heat exchanger, reactor or mixer, with a plurality of ribs (3, 14, 15), wherein at least one row (12, 13) of ribs (3, 14, 15), which define a common rib plane, is arranged, preferably uniformly, distributed and is, preferably uniformly, spaced apart from one another via gaps (4, 18, 19) in the longitudinal extension of the turbulator (1, 10). In order that the dead volumes and therefore the average residence times can be reduced by proportions that are not utilised or are utilised less efficiently for the process in order to keep the respective process medium in a defined and preferred operational state as far as possible over the entire residence time, it is provided that on at least one longitudinal end of the turbulator (1, 10) a hook element (6, 20) is provided for positively hooking a tool (7) to remove the turbulator (1, 10) from the channel (21, 23, 31, 42).

19 Claims, 7 Drawing Sheets

(56) References Cited

U.S. PATENT DOCUMENTS

| | | | | |
|---|---|---|---|---|
| 9,676,672 | B2 | 6/2017 | Lang | |
| 2005/0126212 | A1* | 6/2005 | Jung | F28F 13/12 62/476 |
| 2005/0189092 | A1* | 9/2005 | Jahn | F28F 13/12 165/109.1 |
| 2006/0016582 | A1 | 1/2006 | Hashimoto et al. | |
| 2009/0113909 | A1* | 5/2009 | Liu | F24S 80/30 62/235.1 |
| 2013/0047842 | A1* | 2/2013 | Halder | B01D 53/06 96/115 |
| 2016/0201944 | A1 | 7/2016 | Zhang et al. | |
| 2018/0238630 | A1* | 8/2018 | Pollard | F28D 9/0062 |

FOREIGN PATENT DOCUMENTS

| | | | |
|---|---|---|---|
| CN | 1755316 | A | 4/2006 |
| CN | 103097124 | A | 5/2013 |
| CN | 104168995 | A | 11/2014 |
| DE | 8617733 | U1 | 8/1986 |
| DE | 10351845 | A1 | 6/2005 |
| DE | 112004002439 | T5 | 6/2008 |
| DE | 102012216945 | A1 | 5/2014 |
| EP | 1486749 | A2 | 12/2004 |
| EP | 1995545 | B1 | 4/2016 |
| GB | 2053445 | A | 2/1981 |
| JP | 2007212120 | A | 8/2007 |
| WO | 2014044624 | A1 | 3/2014 |

* cited by examiner

TURBULATOR AND CHANNEL AND PROCESS APPARATUS WITH A TURBULATOR

CROSS-REFERENCE TO RELATED APPLICATIONS

This application is the United States national phase of International Application No. PCT/EP2018/086395 filed Dec. 20, 2018, and claims priority to German Patent Application No. 10 2017 131 418.0 filed Dec. 29, 2017, the disclosures of which are hereby incorporated by reference in their entirety.

BACKGROUND OF THE INVENTION

Field of the Invention

The invention relates to a turbulator for a channel of a process apparatus, in particular a heat exchanger, reactor or mixer, with a plurality of ribs, with at least one row of ribs, which define a common rib plane, being arranged, preferably uniformly, distributed and is, preferably uniformly, spaced apart from one another via gaps in the longitudinal extension of the turbulator. Furthermore, the invention relates to a channel of a process apparatus, in particular a heat exchanger, reactor or mixer with at least one turbulator of the mentioned type provided in the interior of the channel. In addition, the invention relates to a process apparatus, in particular a heat exchanger, reactor or mixer with at least two channels of the mentioned type connecting one another and arranged axially one after another and/or parallel next to one another in the longitudinal extension.

Description of Related Art

For an entire row of process-related basic operations, material flows, in particular fluids, are guided through channels in order to treat, condition or convert the material flows in a suitable manner. In particular, heat exchanger often have channels which can be formed by pipes in order to heat, cool, evaporate and/or condense material flows. Reactions can take place in reactors, while the material flows flow through the channels. Corresponding channels can also serve to mix material flows, while they flow through the channels. In addition, a plurality of these process-related basic operations can also be carried out at the same time in one channel. Thus, for example, mixing material flows and reacting material flows can take place at the same time. In addition, discharging or providing the reaction enthalpy can be ensured during the reaction via the wall of the channel. In particular, the heat exchange is favoured by the turbulent flow. In addition, the material flows can be formed by single-phase systems or multi-phase systems. Two-phase systems are often formed here by non-mixable liquids or gas/liquid systems.

In this case, it is often desired for the process-related basic operation to be carried out in a channel when a turbulent flow is set in the channel. If this does not already occur due to the flow velocity and the shape of the channel, at least one turbulator can be introduced into the channel. The turbulator is shaped here such that the material flow flowing along the turbulator produces a turbulent flow profile or a flow profile at least with cross-flow. For this purpose, turbulators are known which are equipped with a plurality of ribs, of which, a row or two rows of ribs is/are arranged uniformly distributed, and is/are, uniformly, spaced apart from one another via gaps in the longitudinal extension of the turbulator. In this case, the ribs of at least one row are arranged such that they define a common rib plane. In other words, the entire row of ribs is intersected by a rib plane or all ribs of the row of ribs lie in the rib plane. In the latter case, the ribs do not of course lie completely in the rib plane since the ribs, unlike the rib plane, also notably extend in the direction perpendicular to the rib plane.

The turbulators are also not fixedly connected to the channels, but rather are inserted removeably into the channels. In this manner, the channels can be cleaned from time to time and do not block. Cleaning the channels with inserted turbulators is, in contrast, difficult to achieve and only conceivable in exceptional cases. Consequently, the turbulators have at their longitudinal ends eyelets at which the turbulators can be grasped in order to be able to pull them out and insert them into the typically very narrow channels. Since a turbulator, in particular a plurality of turbulators extend over the entire width of the channel and/or the channels are typically designed to be very narrow, the turbulators are adapted to the channels such that the eyelets are arranged outside of the channels in the operational state, where they can be grasped with corresponding tools of corresponding size in order to be able to reliably pull the turbulators out of the channels or insert them into the channels. Corresponding turbulators, channels and process apparatuses are for example already known from EP 1 486 749 A2.

Through the design of the turbulators, the corresponding process apparatuses have larger volume regions in which a turbulent flow does not prevail. Thus, dead volumes are formed, i.e. volumes which do not deliver any or no notable contribution to the process-related basic operation provided in the process apparatus and increase the average residence times in process apparatuses. Both are undesired from a process-related viewpoint, but generally not entirely avoidable. In process-related technology, such volumes are generally designated as dead volumes, in which the flow entirely or at least virtually comes to a standstill. In the present case, the term 'dead volume' should, however, be understood, as previously outlined, in that the flow itself does not come to a standstill in the dead volume, but rather the turbulence of the flow or it is reduced at least significantly. The present use of the term dead volume for corresponding volumes is also due to the fact that there is no generally valid technical term for this.

Therefore, the object underlying the present invention is to design and further develop the turbulator, the channel and the process apparatus in each case of the type mentioned at the outset and described in detail above such that the dead volumes and therefore the average residence times can be reduced by proportions that are not utilised or are utilised less efficiently for the process in order to keep the respective process medium in a defined and preferred operational state as far as possible over the entire residence time.

SUMMARY OF THE INVENTION

This object is achieved with a turbulator according to the invention in that a hook element is provided on at least one longitudinal end of the turbulator for positively hooking a tool to remove the turbulator from the channel.

The mentioned object is also achieved with a channel according to the invention, in that the at least one turbulator is a turbulator according to the invention.

Additionally, the previously-mentioned object is achieved by a process device, in particular a heat exchanger, reactor or mixer, with at least two channels connecting one another and arranged axially one after another and/or parallel next to one another in the longitudinal extension.

The invention recognised that the use of a hook instead of an eyelet can be utilised so that the at least one turbulator can be completely received in the channel. It is not required that the hook element protrudes outwards from the channel like the eyelet. The hook element can namely also be grasped by a tool without problems when the hook element is completely received in the channel. The hook element can namely be grasped with a tool without problems, said tool can be introduced into the channel and even when it is a very narrow channel. Through the arrangement of the hook, it can also be ensured that the tool is introduced into the channel unhindered by further turbulators. The tool can thus be introduced into the channel such that the hook element can be securely grasped and the turbulator can be securely pulled out of the channel.

This is the case in particular when the hook element with the at least one row of ribs defines a common rib plane. Then, the tool can also be arranged in this plane in order to grasp the hook element of the turbulator. Thus, it can be ensured by suitable configuration of the turbulator that the hook element can be grasped by the tool. This is in particular therefore the case because the tool in any case on its front end engaging behind the hook element does not have to be designed wider than the hook element or the turbulator itself. At the same time, a sufficiently large force may be exerted by a correspondingly configured tool on the turbulator or its hook element in order to be able to securely and reliably pull the turbulator out of the channel. With a suitable configuration, the tool can also be guided through the channel in order to grasp the hook element of a turbulator and then pull it through the entire channel.

When the turbulator ends, as required, at least substantially flush with the end of the channel, the tool can be moved out of engagement with the hook element. The turbulator then remains in the corresponding position. In order to pull the turbulator out of the channel again, a hook element is engaged behind at one end of the turbulator with a tool and the entire turbulator is pulled out of the channel. Alternatively or additionally, the operation of the turbulator is simplified and the flexibility is increased for its use when the turbulator has at least one hook element of the mentioned type at each of the two opposing longitudinal ends.

Additionally, providing a hook on the turbulator enables a plurality of turbulators to be provided in the channel next to one another which can each be pulled out of the channel independently of one another and in any order using one and the same tool without a single hook element of a single turbulator having to protrude outwards from the channel. Thus, very high flexibility is achieved overall with the configuration or use of the channel such that the channel can be adapted to the most varied of material flows and operational conditions. However, it is also preferred when a plurality or all turbulators arranged next to one another can be grasped in one channel together by a suitable tool and pulled out of the channel. This is in particularly easily achieved when the hook elements of the adjacent turbulators are also arranged in the channel next to one another. In this connection, it may also lend itself when the respective tool is roughly as wide as the channel itself.

Due to the fact that the at least one turbulator can be arranged completely in the channel as a result of the hook, the channels can be embedded into the process apparatus without having to consider the turbulators. The channels can for example be received parallel to one another and flush with an outer side in a plate. A collection space can be attached to the plate in which the material flows can be collected from the parallel channels. However, deflections can also be provided to connect every two separate channels, through which flow occurs, in particular in series. The fluid escaping from a channel can consequently be deflected and guided in a further channel, with the fluid then, as required, flowing in opposite directions one after another though the correspondingly connected channels. Thus, for example long channel lengths can be provided without also requiring a very long process apparatus for this purpose. In addition, the deflections can be provided with very low dead volumes since the turbulators do not protrude from the channels into the deflections. However, a further identical plate with an identical number of channels can also optionally be attached. Thus, an accumulation of material flows between the plates can be avoided in which signs of separation result, in particular in the case of two-phase systems, such as gas/liquid systems or two non-mixable liquids of different density. The plates and/or channels can abut bluntly on one another and namely, as required, even without a seal element being provided therebetween. A seal element between the plates and/or channels is preferred in many cases, but it is then preferred in many cases when a separate seal element is not assigned to each channel and/or to each channel pair. It can thus ultimately be achieved that every two channels merge directly into one another without resulting in mixing of material flows from different channels. Thus, different or identical channel lengths can ultimately be combined piece by piece in order to thus form suitable overall channel lengths.

The process apparatuses can accordingly, as required, be structured modularly in order to be suitably combined depending on the application. In other words, individual system sections of a process apparatus can be designed identically and in this case can have the same or different lengths. In addition to this is the fact that in the connection region of two channels arranged one after another a continuously turbulent flow can be ensured. The ribs of the turbulator can namely be introduced up to the ends of the channel in spite of the hook. This consequently applies equally for both channels connecting to one another. In other words, a turbulator leads to the flow remaining turbulent up to the end of the channel, while another turbulator ensures that a turbulence is impressed on the flow even at the start of the channel and vice versa. Depending on the configuration of the turbulator, the ribs can also be introduced up to the ends of the channels at the opposing longitudinal ends. In particular for the case where a hook element is also provided at these longitudinal ends of the turbulators and the ribs are inclined to the longitudinal extension of the turbulator, the ribs can, at these longitudinal ends, for constructive reasons, not be introduced up to the assigned ends of the channel.

The corresponding connection of the individual system sections one after another to form a suitable total length of the process apparatus can be implemented with a very small dead volume since the turbulators do not protrude from the corresponding channels into the connection region of the channels.

For better clarity and to avoid any unnecessary repetitions, the turbulator, the channel and the process apparatus are discussed together below without distinguishing in each case individually between the turbulator, the channel and the process apparatus. However, on the basis of the context, it will be apparent to the person skilled in the art which feature is in each case preferred for the turbulator, the channel and the process apparatus.

In the case of the first particularly preferred configuration of the turbulator, the hook element has at least one hook surface extending perpendicular to the longitudinal extension of the turbulator and/or inclined in the direction of the free end of the hook element viewed in the direction of the opposite longitudinal end of the turbulator. Using this hook surface, a high pull-out force can be exerted on the turbulator when it is engaged using a preferably hook-shaped tool. By aligning the hook surfaces, slipping of the tool from the turbulator can namely be avoided when the tool, which is positively engaged on the turbulator, is pulled in the longitudinal direction of the turbulator. Alternatively or additionally, for the same reason, it can be provided that the hook element has an undercut and namely viewed from the longitudinal end of the turbulator comprising the hook element into the direction of the longitudinal end of the turbulator opposite the hook element in the longitudinal direction. This undercut can then be reliably engaged behind by a tool, preferably with a corresponding undercut and/or a corresponding hook element.

In order to improve and/or to homogenise the flow properties, at least two rows of ribs can be provided in the longitudinal extension of the turbulator which define a common rib plane. Thus, a more uniform structure of the turbulator is achieved such that the turbulator can be suitably introduced into a rectangular channel and namely in particular together with further identical turbulators. In addition, it is further preferred when the ribs of the rows of ribs are in each case arranged uniformly distributed, and/or are, uniformly, spaced apart from one another via gaps. This leads to a flow which is more homogenous over the longitudinal extension of the turbulators.

If the turbulator has a single row of ribs, the ribs define a common rib plane for a preferred uniform structure of the turbulator. If the turbulator has a plurality of rows of ribs, then the ribs of all rows of ribs preferably define a common rib plane in order to ensure the desired uniform structure of the turbulator.

Alternatively or additionally, the hook element and the ribs of the at least one row of ribs define a common rib plane. Thus, the hook element inhibits the turbulator being inserted into the channel and the turbulator being pulled out of the channel, if at all, only insignificantly.

Alternatively or additionally, it can be provided that all ribs of the turbulator define a common rib plane. This also leads to the turbulator being inserted and pulled out very reliably and trouble-free.

In order that the flow in the channel is uniformly turbulent and predictable and therefore calculable, it lends itself when the ribs and/or gaps of at least one row of ribs are arranged at least substantially parallel to one another. This also simplifies the constructive and the production-related effort for the turbulator.

In order, on the one hand, to be able to compensate tolerances when producing the inner dimensions of the channel, to not limit the free flow cross-section too much and to reduce the production effort, it may be expedient when the ribs of at least one row of ribs have a free, preferably outer end. In order to also provide a stable turbulator, which permanently retains its shape, it lends itself, alternatively or additionally, when the ribs of the at least one row of ribs, each with one end, are fixed on a web extending in the longitudinal direction of the turbulator. In this case, it is particularly expedient for easily introducing the turbulator into the channel and easily pulling the turbulator out of the channel when the ribs of the at least one row of ribs and the web connecting the ribs of the at least one row of ribs define a common rib plane.

In order that the flow of the channel through the web is not particularly negatively affected in an edge region and thus, as required, disadvantages in regard to the heat exchanger have to be accepted, the free ends of the ribs of at least one row of ribs can be arranged on one side of the web and the free ends of the ribs of the at least one other row of ribs can be arranged on the opposing side of the web. In this case, the flow is particularly predictable and consequently can be precisely calculated when the web is provided at least substantially in the centre between two rows of ribs.

In order, on the one hand, to be able to compensate tolerances when producing the inner dimensions of the channel, to not limit the free flow cross-section too much and to reduce the production effort, it may be expedient to incline at least some ribs, preferably the ribs of at least one row of ribs, at an angle of between 15° and 70°, preferably of between 30° and 60°, in particular of between 40° and 50°, with respect to the web. The pulling of the turbulator into the channel and namely in the correct direction can then lead to a slight elastic bending of the free ends in the direction of the web. Alternatively or additionally, it can be ensured that the ribs are in contact with the channel, for instance to improve the heat exchange. Alternatively or additionally, the rows of ribs on opposing sides of the web can be inclined in the direction of the same longitudinal end of the turbulator and/or web in order to achieve the above advantages.

In the case of a first particularly preferred configuration of the channel, it is provided that the at least one turbulator is completely received in the channel in the longitudinal direction of the channel and/or of the turbulator. The connection dimensions of the channel and the connections of the channel are at least substantially independent of the receipt of the at least one turbulator in the channel.

Alternatively or additionally, the at least one hook element of the at least one turbulator can end at least substantially at one edge of the channel. Thus, even at the beginning of the channel and/or up to the end of the channel, a turbulent flow is ensured. Therefore, it is also preferred when the turbulator ends at least substantially at both opposing terminal edges of the channel. When a hook element is also provided at both longitudinal ends of the turbulator, the flexibility of the operation of the turbulator is particularly high. The turbulator can be grasped from each side with a tool and, as required, it is irrelevant with which end first the turbulator is inserted into the channel.

In order to be able to fill the channel better using at least one turbulator and in the case of a plurality of turbulators, to be able to use identical or at least similarly designed turbulators, it lends itself when the channel is designed as a rectangular channel. In particular in the interior of a rectangular channel, a plurality of turbulators can also be provided to set the desired flow. For the sake of simplicity, they are arranged parallel to one another. However, rectangular channels allow for the use of identical turbulators in one and the same channel next to one another, with the only difference, as required, lying in the respective alignment of the adjacent turbulators. It is particularly preferred here when two turbulators are provided parallel to one another and next to one another in the at least one channel. It is further preferred in the sense of using identical parts when these turbulators are designed identically. Alternatively or additionally, the turbulators can be provided in an opposite longitudinal extension to one another. The turbulators thus point with the same ends in opposite longitudinal directions of the channel. In other words, at least two parallel turbulators can be arranged next to one another in the opposite longitudinal extension in the channel.

In the case of wider channels, three or four turbulators arranged parallel to one another and next to one another in the at least one channel can also be provided. However, other numbers are also conceivable. The configuration and arrangement of the turbulators can also be provided, as described previously for two turbulators. In flow-related technology, particularly preferred results are obtained when the projection of the at least one turbulator in the longitudinal extension of the channel fills the cross-section of the assigned channel or the projection of the channel in its longitudinal extension to at least 75%, preferably at least 80%, in particular at least 85%. Accordingly, the gaps between the at least one turbulator and the channel and/or between the turbulators in the channel are small such that a very defined and optimised flow can be provided in the channel. The latter allows in particular a high degree of turbulence with simultaneously moderate volume flow of the fluid.

In the case of a first particularly preferred configuration of the process apparatus, at least two channels are arranged on the front face abutting one another in a row, and at least one seal element can, but does not have to be, provided, as required, between the channels. Thus, separation processes of the material flow can be avoided and/or inexpedient dead spaces for the flow can be reduced. The flow is guided targetedly and relatively trouble-free from one channel into the next channel. In this case, the two channels assigned to one another can be arranged aligned with respect to one another or partially offset to one another and namely in a direction perpendicular to the longitudinal direction of the channel and parallel to the at least one turbulator. In this way, a stop for inserting the turbulator into a channel is provided for at least one turbulator and namely through the end of the other, partially offset channel. In other words, the at least two channels partially offset to one another can, in the connection region of the two channels, form at least one stop for at least one turbulator in one of the two channels.

Alternatively or additionally, a plurality of channels according to any one of claims 7 to 10 can in each case be arranged parallel to one another. Channel bundles can thus easily be formed which can, as required, form a system section of the process apparatus. The channel bundles can be flexibly combined to form larger units and namely from a flow-technology point of view, parallel as well as serially. In this case, it lends itself in particular when the plurality of parallel channels are arranged in each case, preferably partially offset to one another, on the front face with a further channel abutting one another in a row.

It is particularly expedient for scaling or adaptation of the process apparatus when at least two separate system sections are each provided with a plurality of channels arranged parallel to one another and the system sections are connected to one another preferably via a flange connection such that the channels of the at least two system sections in each case, as required, partially offset to one another, connected to one another abutting on the front face and are arranged in a row with respect to one another.

BRIEF DESCRIPTION OF THE DRAWINGS

The invention is explained in detail below on the basis of a drawing merely representing an exemplary embodiment. In the drawing is shown.

DETAILED DESCRIPTION OF THE PREFERRED EMBODIMENTS

Figure 1:
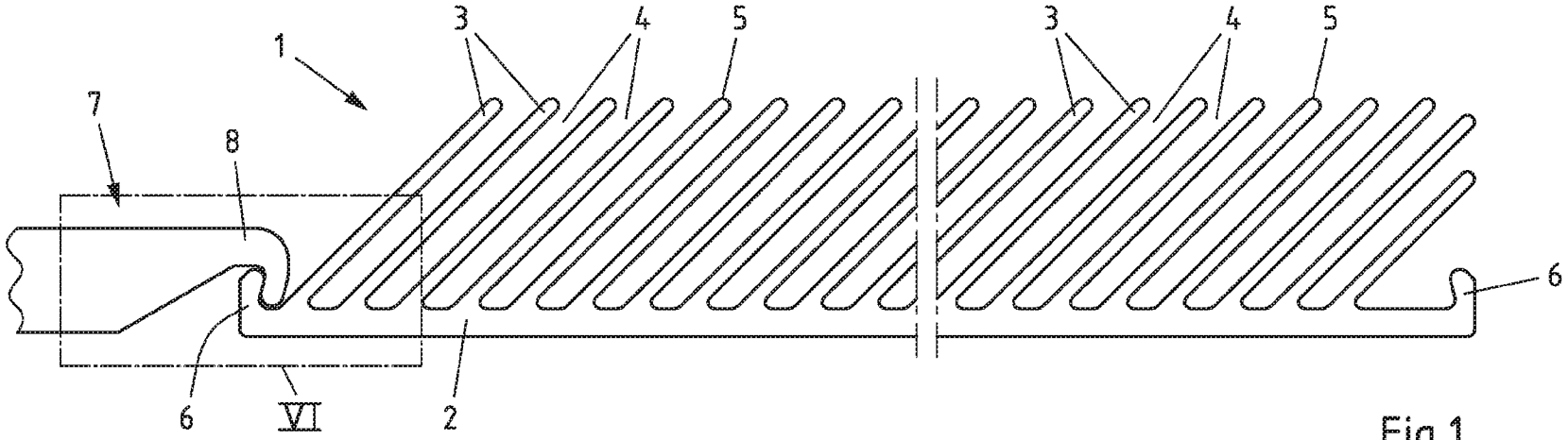
FIG. 1 a first exemplary embodiment of a turbulator with a tool for pulling the turbulator out of a channel in a plan view, FIG. 2 a first exemplary embodiment of a turbulator in a plan view, FIG. 3A-B a channel with a plurality of turbulators according to FIG. 1 in a sectional view in the longitudinal direction and in a sectional view in the transverse direction, FIG. 4A-B a channel with a plurality of turbulators according to FIG. 2 in a sectional view in the longitudinal direction and in a sectional view in the transverse direction, FIG. 5 channels of a process apparatus connected to one another to extend the total channel length in a schematic plan view, FIG. 6 a hook element of the turbulator from FIG. 1 in an enlarged representation, FIG. 7 a process apparatus with two system sections comprising in each case a plurality of channels and connected in the longitudinal direction in a schematic side view, FIG. 8 a detail of a process apparatus with channels connecting in the longitudinal direction in a schematic side view and FIG. 9 a detail of a process apparatus with a plurality of channels parallel to one another and arranged next to one another in a schematic view.

In FIG. 1 is a turbulator 1 with a web 2 extending in the longitudinal direction and a row of ribs 3 which are connected to one end with the web 2. The ribs 3 define, together with the web 2, a rib plane which intersects the web 2 and the ribs 3. In addition, the web 2 and the ribs 3 are aligned parallel to the rib plane. The ribs 3 are inclined with respect to the web 2 and namely by roughly 45°. In addition, the ribs 3 are arranged parallel to one another and in each case spaced apart from one another by gaps 4, which are also aligned parallel to one another. The free ends 5 of the ribs 3 are arranged on the side of the turbulator 1 facing away from the web 2, with the free ends 5 being arranged along a line in the turbulator 1 that is represented and in this respect preferred, said line also running parallel to the web 2. Each hook element 6 is provided on the longitudinal ends of the web 2 opposed to one another which, together with the ribs 3 and the web 2, defines a common rib plane. Each hook element 6 is intersected by the rib plane and is aligned parallel to the rib plane. As represented by way of example, the hook element 6 can be positively engaged behind from the respectively free longitudinal end of the turbulator 1 by a tool 7 with a corresponding hook element in order to pull the turbulator 1 out of a channel, even though the turbulator 1 is completely received in the channel and consequently does not protrude outwards with respect to the channel. The front end 8 of the tool 7 can be formed for this purpose maximally as wide as the turbulator 1. If the turbulator 1 can be inserted into a channel, accordingly, the tool 7 can also be introduced with its front end 8 into the channel in order to engage behind a hook element 6 of the turbulator 1. Alternatively or additionally, the front end 8 of the tool 7 can be designed maximally as wide as the channel receiving the turbulator. As required, a plurality of turbulators 1 arranged next to one another in a channel can be grasped on their hook elements 6 with a tool 7 and be pulled out of the channel together.

Figure 2:
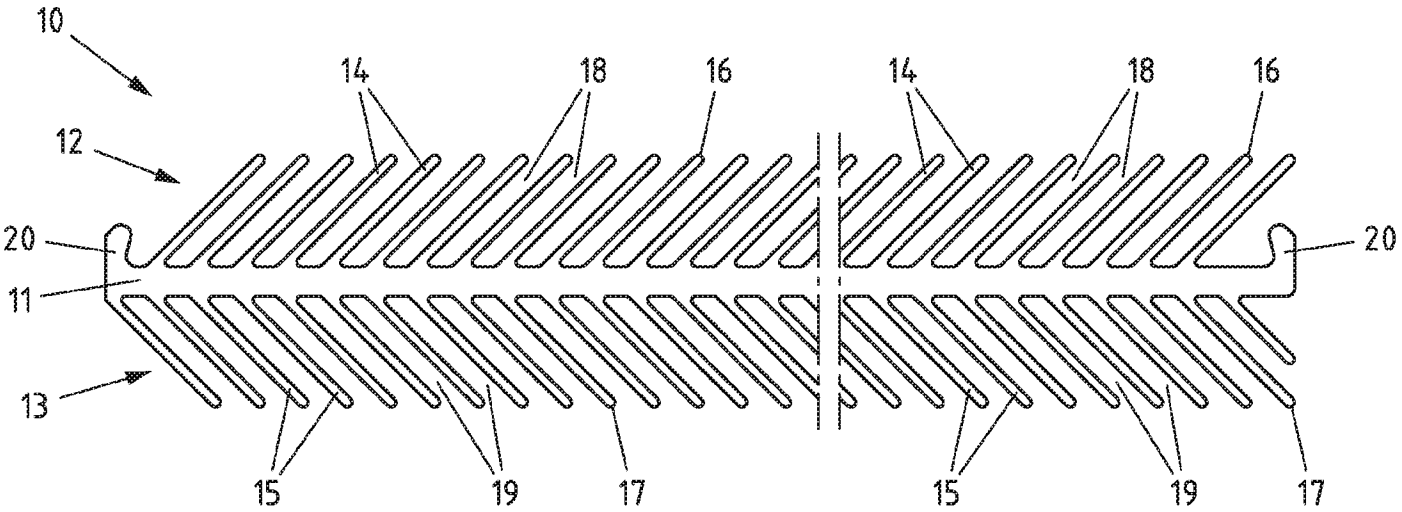

An alternative turbulator 10 is represented in FIG. 2. It also has a web 11 extending in the longitudinal direction of the turbulator 10 which is connected to two rows 12, 13 of ribs 14, 15. The rows 12, 13 of ribs 14, 15 extend from the web 11 in different, in particular opposite directions and end in free ends 16, 17 there. The free ends 16, 17 of each row 12, 13 of ribs 14, 15 lie in the turbulator 10 represented and in this respect preferred on a line which is also aligned parallel to the web 11. The individual ribs 14, 15 of the rows 12, 13 of ribs 14, 15 are in each case aligned parallel to one another. The rows 12, 13 of ribs 14, 15 are also separated from one another by in each case parallel gaps 18, 19 and are inclined with respect to the web 11 in the same direction. Similarly, in each case one hook element 20 is provided on the two longitudinal ends of the turbulator 10 which, together with the ribs 14, 15 and the web 11 of the turbulator 10, defines a common rib plane. The ribs 14, 15, the web 11 and the hook elements 20 are intersected by the common rib plane and are also aligned in each case parallel to the rib plane. Otherwise, in the turbulator 10 represented and in this respect preferred, the web 11 is arranged roughly in the centre to the transverse direction of the turbulator 10. The hook elements 20 can be engaged behind by a tool 7 which does not have to be wider on its front end 8 than the respective hook element 20. Consequently, the front end 8 of the tool 7 can be engaged into a channel in order to engage behind the corresponding hook element 20 in a positive manner.

Figure 3B:
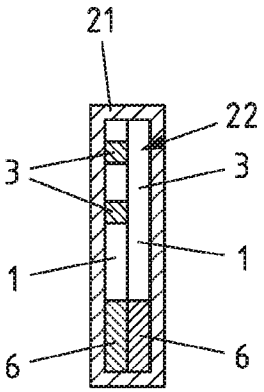
Figure 3A:
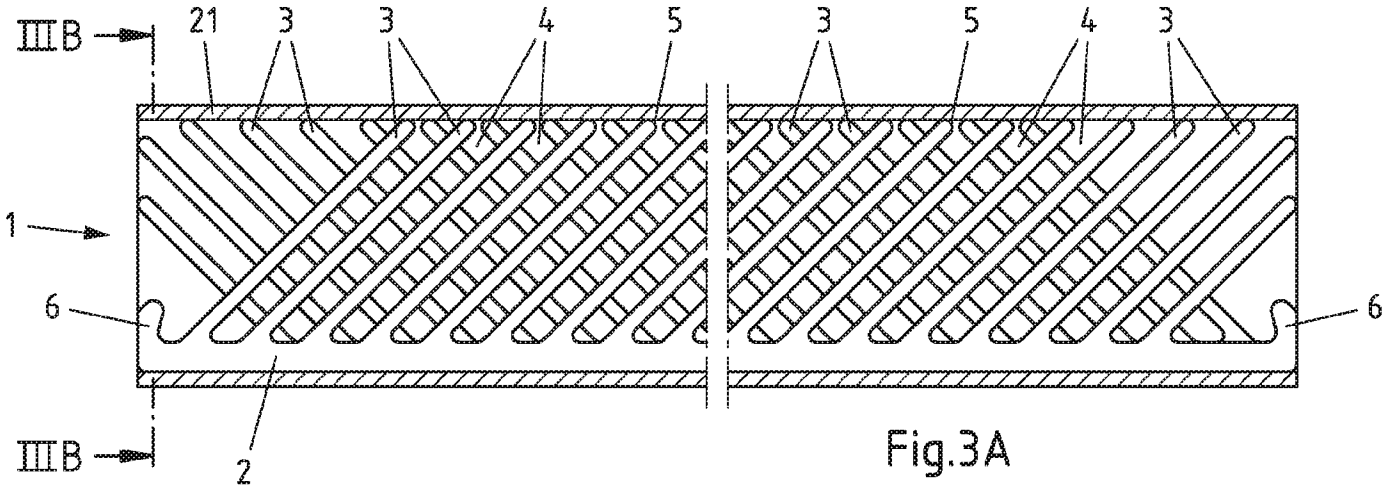

A rectangular channel 21 with a roughly rectangular flow cross-section 22 is represented in FIG. 3A-B in which a plurality of turbulators 1, as represented in FIG. 1, are inserted, with the turbulators 1 being arranged in different alignments, as required, alternatingly to one another or in the opposite longitudinal extension in the channel 21. Identical longitudinal ends of adjacent turbulators 1 are accordingly assigned to opposing ends of the channel 21. As a result, the ribs 3 of adjacent turbulators 1 are inclined in opposite directions, the channel 21 can be flowed through and the turbulators 1 impress a turbulence on the flow. In addition, the turbulators 1 are received completely in the channel 21 in the case of the channel 21 represented and in this respect preferred. Furthermore, both longitudinal ends of the turbulator 1 extend at least substantially up to the longitudinal ends of the channel 21. The channel 21 has a cross-section 22 that is at least substantially rectangular in order to be able to receive turbulators 1, which are similar and have identical dimensions, next to one another. The projections of the two turbulators 1 in the longitudinal direction of the channel 21 fill the cross-section of the channel 21 or the projection of the channel 21 in its longitudinal direction to at least 75%, preferably at least 80%, in particular at least 85%. The length of a corresponding channel 21 is here preferably at least 0.2 m, in particular at least 0.5 m, further in particular at least 1 m. Moreover, it may be preferred when the corresponding channel 21 is less than 3 m, in particular less than 2 m, further in particular less than 1.5 m or less than 1 m long.

Figure 4B:
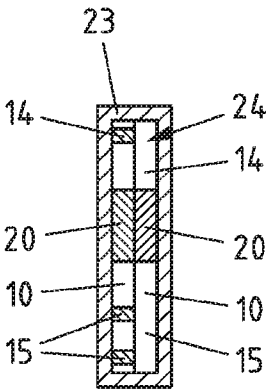
Figure 4A:
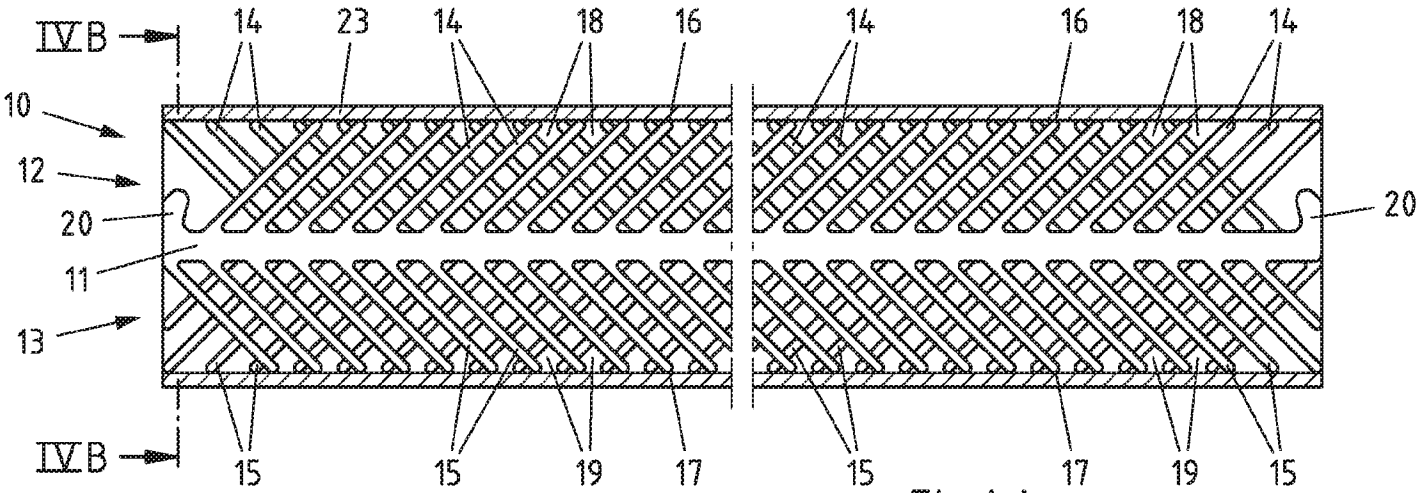

A rectangular channel 23 with a roughly rectangular flow cross-section 24 is represented in FIG. 4A-B into which a plurality of turbulators 10, as represented in FIG. 2, are inserted, with the turbulators 10 being arranged in different alignments, as required, alternatingly to one another. Identical longitudinal ends of adjacent turbulators 10 are accordingly assigned to opposing ends of the channel 23. As a result, the ribs 14, 15 of adjacent turbulators 10 are inclined in opposite directions, the channel 23 can be flowed through and the turbulators 10 impress a turbulence on the flow. In addition, the turbulators 10 are received completely in the channel 23 in the case of the channel 23 represented and in this respect preferred. Furthermore, both longitudinal ends of the turbulator 10 extend at least substantially up to the longitudinal ends of the channel 23. The channel 23 has a cross-section 24 that is at least substantially rectangular in order to be able to receive turbulators 20, which are similar and have identical dimensions, next to one another. The axial projections of the two turbulators 10 together fill the inner cross-section of the channel 23 to at least 75%, preferably at least 80%, in particular at least 85%.

Figure 5:
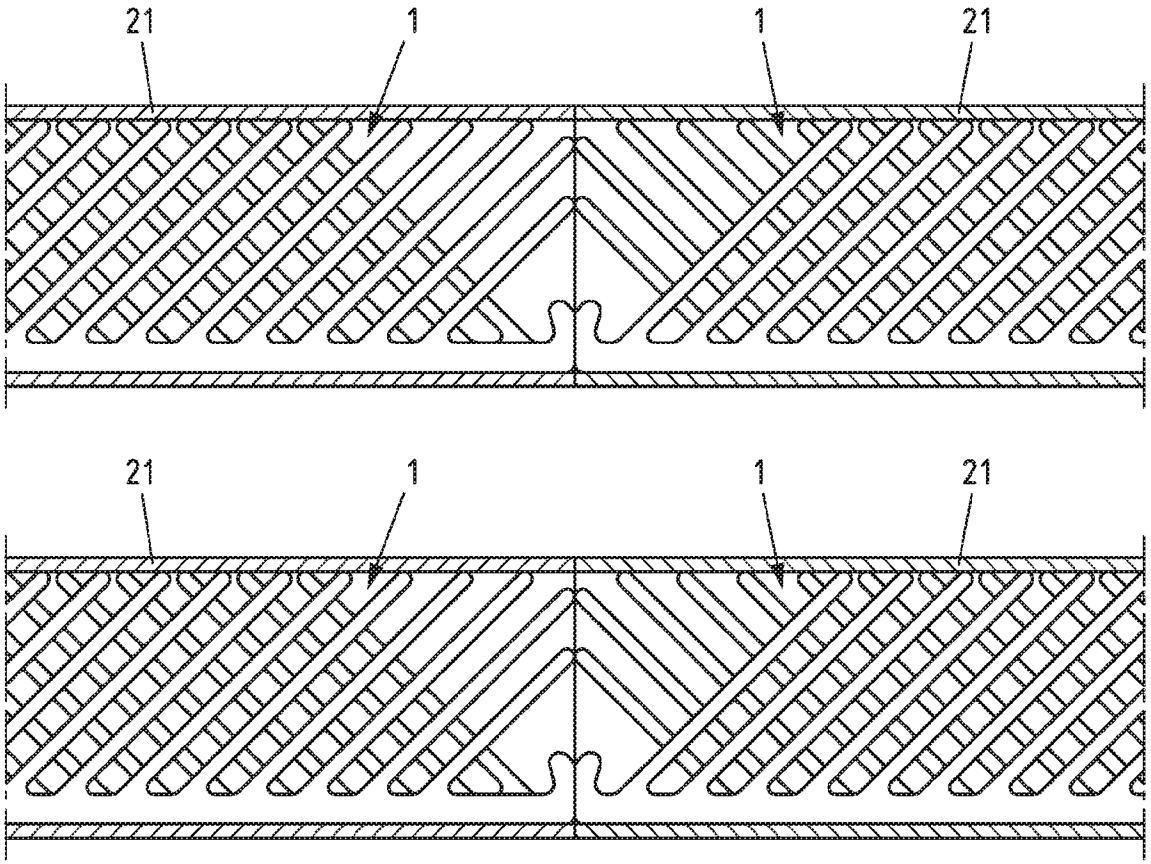

Four channels 21 with turbulators 1 according to FIG. 1 are represented in FIG. 5 of which in each case two are arranged parallel to one another. Consequently, in each case two parallel channels 21 can basically be assigned to one system section of a process apparatus, with two system sections being arranged one after another according to FIG. 5 and therefore being connected one after another. In each case, two channels 21 arranged axially one after another abut here in an aligned and blunt manner against one another without a seal element being provided between the abutting channels 21 in the represented exemplary embodiment. However, a seal element, for instance in the form of an O-ring received in a circumferential groove may also essentially be provided. The flows can thus be readily guided further from the channels 21 first in the flow direction and represented on the left into the channels 21 second in the flow direction and represented on the right. Since the turbulators 1 of the adjoining channels 21 extend up to the connection region, in particular at least substantially up to the adjoining edges of the adjoining channels 21, a turbulent flow is also produced in the transition region between the channels 21, which for example can favour a reaction, accelerate the heat exchange via the wall of the channels and/or cause mixing of different material flows.

Figure 6:
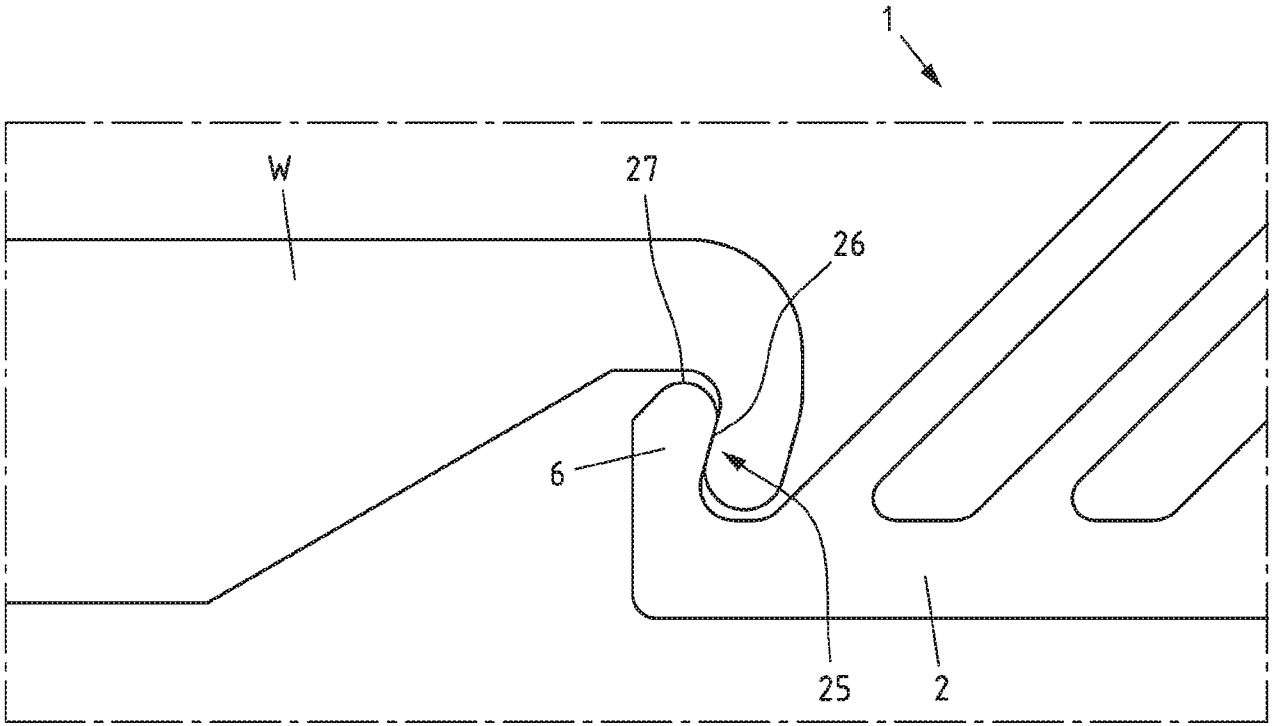

The hook element 6 of the turbulator 1 from FIG. 1 is represented in an enlarged representation in FIG. 6. The hook element 6 forms an undercut 25 viewed from the assigned longitudinal end in the direction of the opposing longitudinal end of the turbulator 1, said undercut can be engaged behind by a tool W represented only schematically, whose front corresponding hook element is preferably not wider than the hook element 6 of the turbulator 1 and/or not wider than the assigned channel 21. Thus, in the case of a plurality of turbulators 1 in a channel 21 each turbulator 1 can be separately grasped by the tool W and be pulled out of the channel 21. If pulling is carried out at the tool W in the longitudinal direction of the turbulator 1 in order to pull the turbulator 1 out of an assigned channel, the tool W does not slip off the hook element 6 as a result of the undercut. This is achieved for instance by a hook surface 26 being provided in the region of the undercut 25 of the hook element 6 to engage with the tool W, which extends either perpendicularly to the longitudinal extension of the turbulator 1 or, as is the case of FIG. 6, is inclined in the direction of the free end 27 to the longitudinal end of the turbulator 1 opposed to the corresponding hook element 6. In other words, the hook surface 26 is, in the turbulator 1 represented and in this respect preferred, inclined from the web 2 to the free end 27 of the hook element 6 in the direction of the opposing longitudinal end of the turbulator 1. If the hook surface 26 were inclined in the opposite direction, there would essentially be the possibility of the tool W unintentionally slipping from the hook element 6, which is prevented through the corresponding alignment of the at least one hook surface 26.

Figure 7:
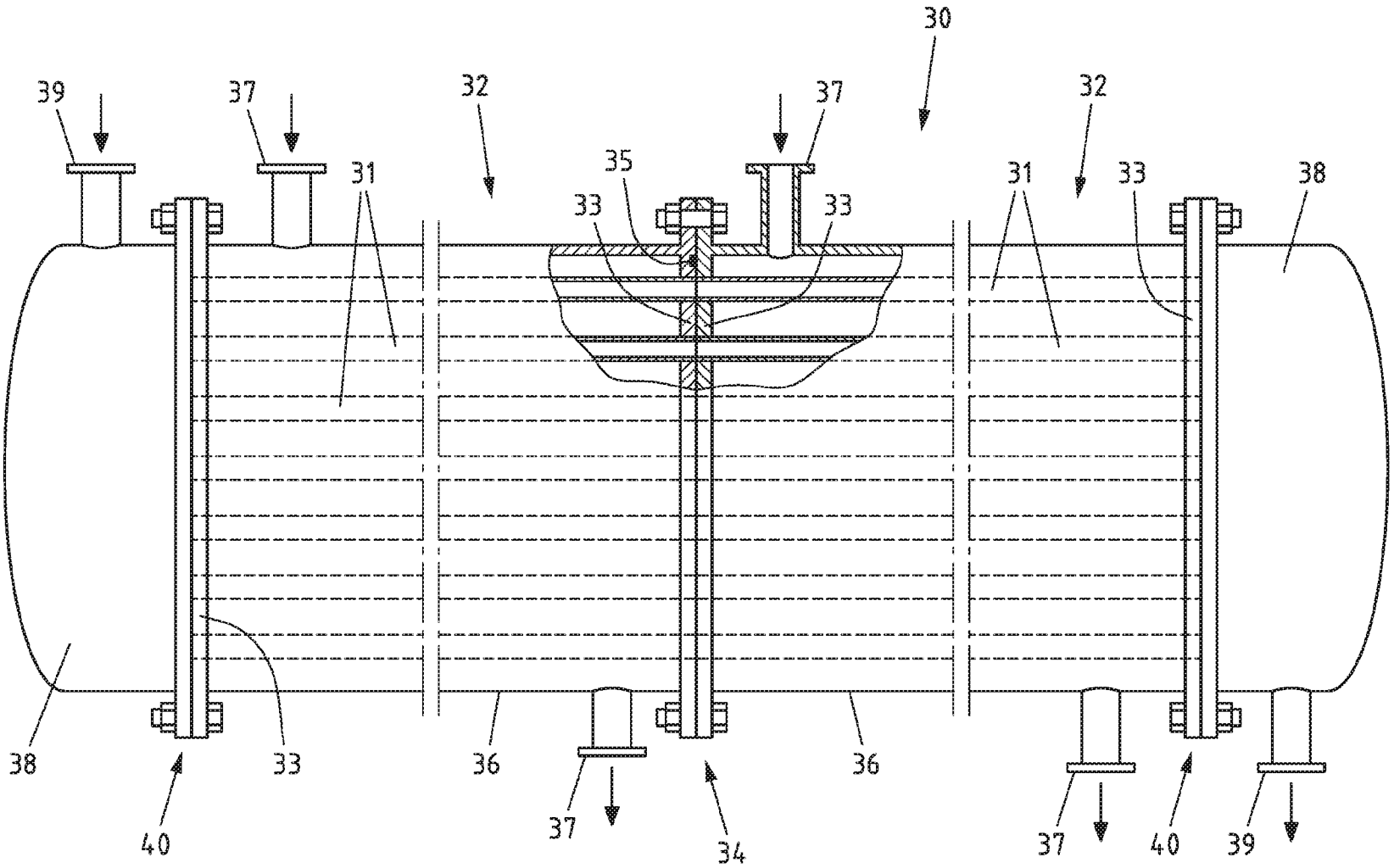

A process apparatus 30 with two system sections 32 each comprising a plurality of channels 31 arranged parallel to one another is represented in FIG. 7 which system sections 32 are arranged one after another in the longitudinal direction of the process apparatus 30. Each system section 32 is delimited in the longitudinal direction by two plates 33 in which the longitudinal ends of the channels 31 are received. The ends of the channels 31 can end here flush with the respective outer sides of the plates 33 for the sake of simplicity here. The system sections 32 or the assigned plates 33 are connected to one another via flange connections 34 or in a different manner, and namely such that the material flows are guided further from the individual channels 31 of the first system section 32 in each case into a channel 31 of the second system section 32 without notable mixing of the material flows from different channels 31 taking place between the channels 31 or between the system sections 32 or the material flows being able to notably separate between the channels 31 or between the system sections 32. As required, further system sections 32 can also be added in the longitudinal extension of the process apparatus 30 when this is useful for the purposes of scaling or adapting to different operational conditions or material flows. This adaptation or scaling is not negatively affected by the turbulators arranged in the channels 31. A circumferential seal element 35 is provided between the plates 33 or system sections 32 in the represented exemplary embodiment which seals the connection region of the two system sections 32 externally. The individual channels 31 are not separately sealed here, although this would essentially be conceivable. The plates 33 and therefore the channels 31 abut bluntly against one another and form only a very slight gap which can essentially be tolerated. For the sake of clearer illustration, turbulators not represented are provided in the channels 31 adjoining one another which, however, do not protrude outwards with respect to the channels 31 such that minimum dead volumes can be realised in the region of the plates 33 as the connection region of the channels 31. The shell space 36 of the system sections 32 between the plates 33 can be flowed through by a heat transfer medium in order to temperature-control the channels 31, for which connectors 37 are provided for introducing and discharging the heat transfer medium. However, this is not necessary. The supply of the material flows into the channels 31 or system sections 32 also takes place just like the collection and discharge of material flows from the channels 31 or the system sections 32 via corresponding bases 39, which are however, also not necessary in the represented shape, via corresponding connectors 39. The bases are connected to the in each case adjoining system section 32 in the represented process apparatus 30 via flange connections 40.

Figure 8:
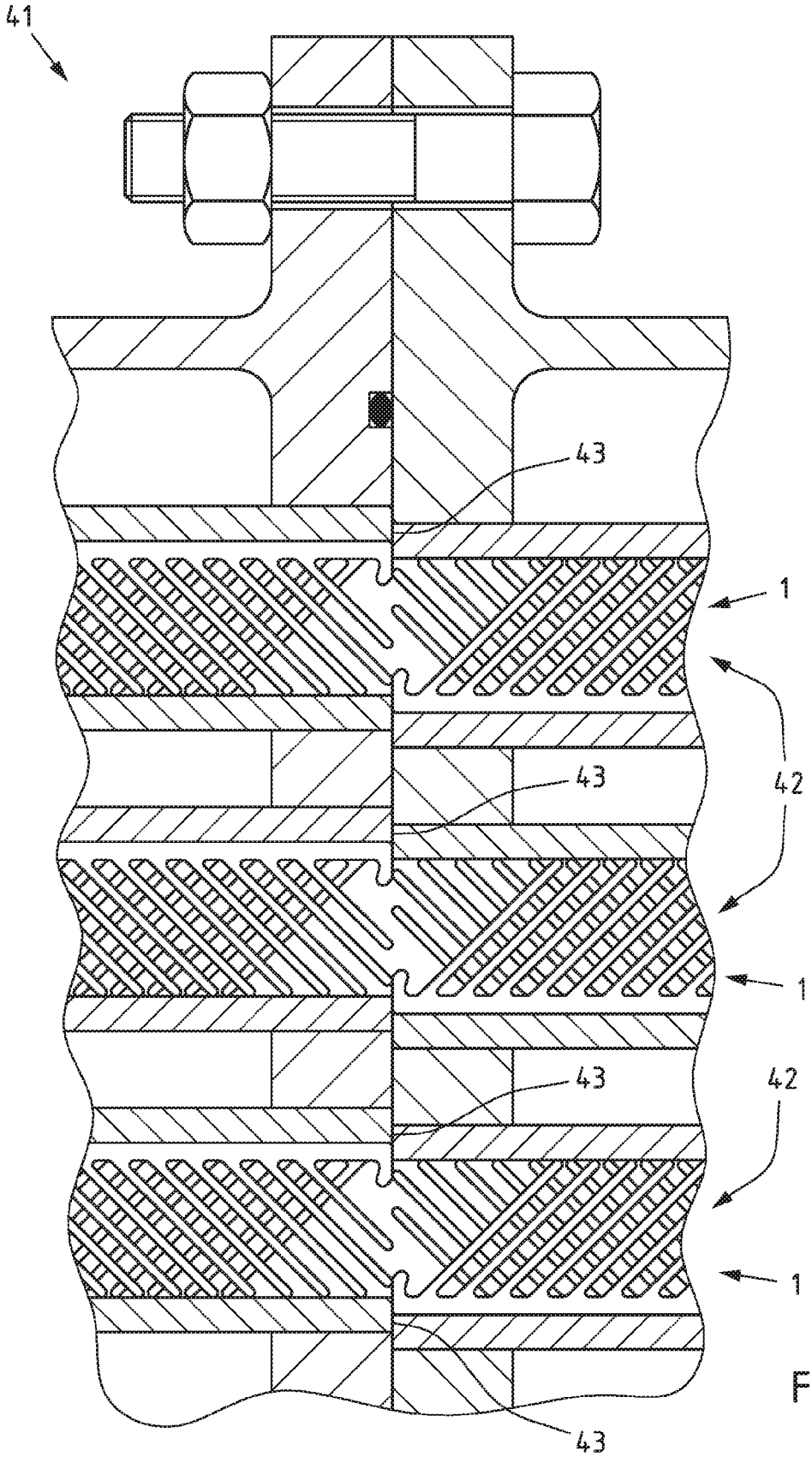

A detail of a process apparatus 41 with channels 42 connected in the longitudinal direction is represented in FIG. 8, with the channels 42 in each case comprising turbulators 1 which are inserted into the assigned channel 42 up to the in each case adjoining channel 42. Unlike the process apparatus 30 represented in FIG. 7, the channels 42 are not flush in the process apparatus 41 of FIG. 8, but rather are arranged slightly offset to one another. The channels 42 are arranged here offset to one another in a direction perpendicular to the longitudinal extension of the channels 42 and parallel to the turbulators 1. As a result, a respectively adjoining end of a channel 42 forms a stop 43 for the turbulators 1 of the adjoining channel 24.

Figure 9:
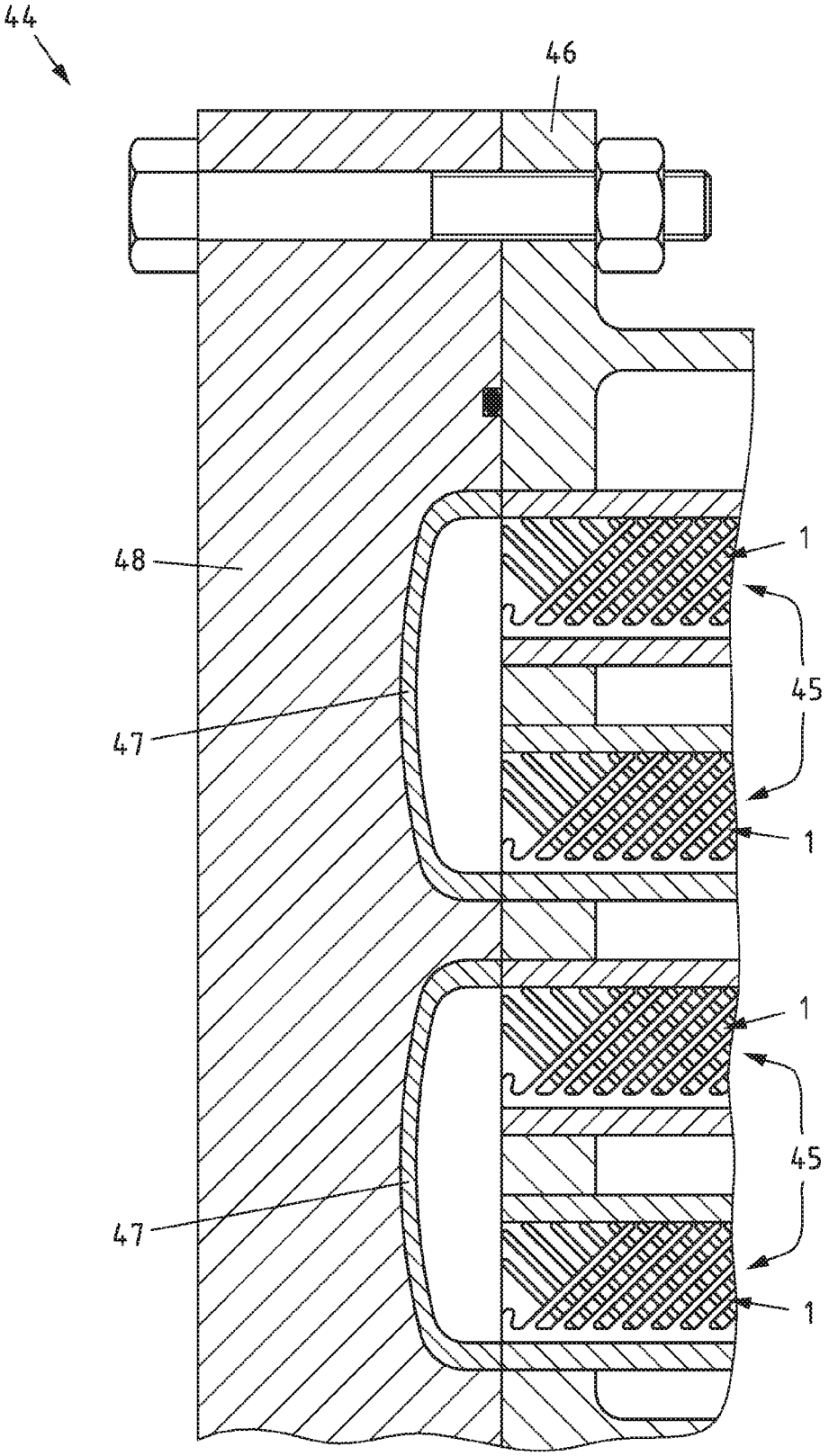

A detail of a process apparatus 44 with channels 45 arranged parallel to one another is represented in FIG. 9, which are all received in a terminal plate 46, to which an end plate 48 adjoins, which has deflections 47 to deflect the flow of a channel 45 into an adjoining parallel channel 45 such that the thus connected channels 45 are flowed through one after another and in the opposite direction. The channels 45 have turbulators 1 which extend up to the end of the respective channels 45 and end at least substantially flush with them. The turbulators 1 of the channels 45 are here in each case introduced into the channels 45 in the opposite longitudinal alignment. The deflections 47 in the end plate 48 can therefore be designed with low dead volume.

List of Reference Numerals

1 turbulator
2 web
3 rib
4 gap
5 free end
6 hook element
7 tool
8 front region
10 turbulator
11 web
12, 13 row
14, 15 rib
16, 17 free end
18, 19 gap
20 hook element
21 channel
22 flow cross-section
23 channel
24 flow cross-section
25 undercut
26 hook surface
27 free end
30 process apparatus
31 channel
32 system section
33 plate
34 flange connection
35 seal element
36 shell space
37 connector
38 base
39 connector
40 flange connection
41 process apparatus
42 channel
43 stop
44 process apparatus
45 channel
46 plate
47 deflection
48 end plate
W tool

The invention claimed is:

1. The channel of a process apparatus, in particular a heat exchanger, reactor or mixer, with at least one turbulator provided in the interior of the channel, the turbulator comprising a plurality of ribs, wherein at least one row of ribs, which define a common rib plane, is arranged and the ribs are uniformly distributed and spaced apart from one another via gaps in the longitudinal extension of the turbulator, a hook element extending parallel with the common rib plane is provided on at least one longitudinal end of the turbulator for positively hooking a tool to pull the turbulator out of the channel characterised in that the channel is designed as a rectangular channel, wherein, in cross-section, the channel provides two narrow sides and two wide sides, and, wherein, both a free end of a head of the hook element and free ends of the at least one row of ribs point toward one narrow side.

2. The channel according to claim 1, characterised in that the at least one turbulator is received completely in the channel in the longitudinal direction of the channel and/or of the turbulator.

3. The channel according to claim 1, characterised in that the at least one hook element of the at least one turbulator ends at least substantially at an edge of the channel.

4. The channel according to claim 1, characterised in that a plurality of, in particular two, three or four turbulators are provided and are arranged parallel to one another in the interior of the channel.

5. The channel according to claim 4, characterised in that at least two parallel turbulators are arranged in the opposite longitudinal extension in the channel.

6. The channel according to claim 1, characterised in that the axial projection of the at least one turbulator fills the cross-section of the channel and/or the axial projection of the cross-section of the channel to at least 75%.

7. The process apparatus, in particular a heat exchanger, reactor or mixer, with at least two channels connecting one another and arranged axially one after another and/or parallel next to one another in the longitudinal extension according to claim 1.

8. The process apparatus according to claim 7, characterised in that the at least two channels are arranged on a front face abutting one another in a row, partially offset to one another.

9. The process apparatus according to claim 7, characterised in that at least two separate system sections is each provided with a plurality of channels arranged parallel to one another and in that the system sections are connected to one another via a flange connection such that the channels of the at least two system sections are each connected on a front face abutting one another and are arranged in a row, partially offset to one another.

10. The process apparatus according to claim 7, characterised in that the at least two channels partially offset to one another, in the connection region of the two channels, form at least one stop for at least one turbulator in one of the two channels.

11. The process apparatus characterised in that a plurality of channels according to claim 1, is arranged parallel to one another and in that the plurality of parallel channels is each arranged on a front face with a further channel abutting one another, partially offset to one another, in a row.

12. The channel according to claim 1, characterised in that the hook element has at least one hook surface extending perpendicular to longitudinal extension of the turbulator and/or inclined in the direction of the free end of the hook element viewed in the direction of the opposing longitudinal end of the turbulator and/or in that the hook element has an undercut when viewed from the hook element in the direction to the opposing longitudinal end of the turbulator.

13. The channel according to claim 12, characterised in that the free ends of the ribs of at least one row of ribs are arranged on one side of the web and the free ends of the ribs of the at least one other row of ribs are arranged on the opposing side of the web and/or in that the web is provided at least substantially in the centre between two rows of ribs.

14. The channel according to claim 12, characterised in that at least some ribs, are inclined at an angle of between 15° and 70° with respect to the web and/or in that the rows of ribs on opposing sides of the web are inclined in the direction of the same longitudinal end of the turbulator and/or web.

15. The channel according to claim 1, characterised in that at least two rows of ribs, which define a common rib plane, are arranged, and the ribs are uniformly distributed and spaced apart from one another via gaps in the longitudinal extension of the turbulator.

16. The channel according to claim 1, characterised in that the single row of ribs and/or all rows of ribs define a common rib plane.

17. The channel according to claim 1, characterised in that all ribs of the turbulator define a common rib plane.

18. The channel according to claim 1, characterised in that the ribs and/or gaps of at least one row of ribs are arranged at least substantially parallel to one another.

19. The channel according to claim 1, characterised in that the ribs of the at least one row of ribs have a free, outer end and/or in that the ribs of the at least one row of ribs are fixed with in each case one end on a web extending in the longitudinal direction of the turbulator and in that the ribs of the at least one row of ribs and the web connecting the ribs of the at least one row of ribs define a common rib plane.

* * * * *